United States Patent [19]

Rohde et al.

[11] Patent Number: 4,477,204

[45] Date of Patent: Oct. 16, 1984

[54] CAST CONCRETE ELEMENT FOR UNDERGROUND TUBULAR STRUCTURE

[75] Inventors: Clarence J. Rohde, 5167 N. Lovers La. Rd., Milwaukee, Wis. 53225; Donald J. Farley, 2241 W. Hart Rd., Beloit, Wis. 53511

[73] Assignees: Clarence J. Rohde; Donald J. Farley; Joseph P. Selhulster, all of Waukesita, Wis.; John R. Hart, Leicestershire, England

[21] Appl. No.: 458,457

[22] Filed: Jan. 17, 1983

[51] Int. Cl.[3] ..... E21D 11/00

[52] U.S. Cl. ..... 405/153; 52/584; 403/372; 405/152; 405/151

[58] Field of Search ..... 405/153, 152, 151, 150; 52/582, 583, 580, 585, 586, 584; 403/372

[56] References Cited

U.S. PATENT DOCUMENTS

| | | | |
|---|---|---|---|
| 1,337,767 | 4/1920 | Hastings | 405/153 |
| 1,670,625 | 5/1928 | Johannesson | 405/153 X |
| 2,798,748 | 7/1957 | Maurer | 403/372 |
| 2,950,937 | 8/1960 | Bedford | 403/372 |
| 3,677,015 | 7/1972 | Chlumecky | 405/153 X |
| 3,779,659 | 12/1973 | Habert | 403/372 |
| 4,299,067 | 11/1981 | Bertschi | 52/584 X |
| 4,318,636 | 3/1982 | Thomas | 52/584 X |
| 4,397,583 | 8/1983 | Horncy et al. | 52/583 |

FOREIGN PATENT DOCUMENTS

| | | | |
|---|---|---|---|
| 603250 | 9/1934 | Fed. Rep. of Germany | 405/153 |
| 1232299 | 5/1971 | United Kingdom | 405/152 |

*Primary Examiner*—Dennis L. Taylor

[57] ABSTRACT

A modular cast concrete element of this invention, capable of being assembled with other, similar elements into a tubular underground installation (e.g., sewer duct, tunnel liner) has a well opening to each of its axially-facing end surfaces wherein a rod is received that is insertable in a like well in an axially adjacent element to guide one of the elements to a predetermined position relative to the other and lock it in that position. In each well is a securement member having an annular radially outer marginal portion confined in a circumferential radially inwardly opening groove in the well and having resilient radially inwardly projecting teeth. The teeth have radially inner edges on a circle of smaller diameter than the rod and are flexible axially to enable the rod to be easily inserted into the securement member but to engage it under convergent bias for holding it against withdrawal from the well. Each securement member is held in the concrete body of the element by a retainer which partially defines the well and defines the groove and which can be assembled from commercial plastic pipe fittings.

10 Claims, 12 Drawing Figures

CAST CONCRETE ELEMENT FOR UNDERGROUND TUBULAR STRUCTURE

FIELD OF THE INVENTION

This invention relates to modular precast concrete elements that can be assembled with one another to form a tubular underground installation such as a duct or a liner for a tunnel or a shaft, and the invention is more particularly concerned with modular concrete elements having connecting means whereby each such element can be quickly brought into and permanently secured in an intended position relative to one or more similar elements that are axially adjacent to it along the length of a tubular installation.

BACKGROUND OF THE PRIOR ART

A type of tunnel liner that has been used abroad for about 50 years and has recently been introduced into the United States comprises modular precast concrete elements that are assembled in a tunnel as digging progresses, to build up a liner behind the digging operation and more or less in step with it. Each such modular element comprises a ring segment having arcuate, substantially concentric inner and outer faces, opposite end faces, and opposite side faces that are adapted to abut side faces of similar, circumferentially adjacent elements. A certain number of such arcuate elements are assembled with one another to form a ring, starting at the bottom of the ring and progressing up along both sides of it. The arcuate elements are usually so dimensioned that there is a small gap between the two uppermost elements in the ring, which gap is filled by a key block that is inserted to complete the ring.

As each new arcuate element is added to a ring under construction, it is locked to an already placed circumferentially adjacent element. For such connection of the elements that comprise a ring, each arcuate element has steel loops at each side of it, each projecting a little beyond its adjacent side face of the element to overlap similar loops on a circumferentially adjacent element. A tapering wedge pin driven into the overlapped loops locks the elements to one another. The loops are so oriented that the wedge pins can be driven into them from inside the ring, in the radially outward direction.

Each of the loops on an arcuate modular element of this prior tunnel liner is located in a pocket or bay that opens to the arcuate inner face of the element and to the side face beyond which the loop projects. Each such pocket receives part of a cooperating loop or loops on a circumferentially adjacent element, to enable the loops to overlap. Because of the configuration of the pockets in relation to the loops, each modular element must be moved in a substantially circumferential direction in order to bring it into assembled relationship to the circumferentially adjacent element to which it is connected. The gap between the uppermost arcuate elements of a ring—subsequently filled by the key block—accommodates such circumferential motion of the last arcuate element assembled into the ring.

After each ring is assembled, the next ring forwardly along the length of the tunnel is assembled in a similar manner. The arcuate elements of each new ring are usually placed in circumferentially offset relation to those of the last-finished ring so that the arcuate elements of successive rings along the tunnel are staggered like bricks in a wall.

The arcuate elements of the ring being asembled are established in their properly staggered positions relative to the elements of the previously assembled ring by means of dowel rods that are received in wells in the completed ring and project forwardly from it. However, because each modular element must be moved circumferentially—not axially—in being assembled into a ring, the dowel rods must be inserted into the finished ring one at a time, each being installed just before a new element of the next ring is set in place. For cooperation with the dowel rods, each element has an axially extending dowel rod groove in each of its end surfaces. When an element is brought to its proper assembled position, its dowel rod groove receives the rod that positions the element.

Although the dowel rod grooves in a pair of circumferentially adjacent modular elements cooperate to define a well in which a dowel rod is received that positions the next axially adjacent element, the dowel rod performs no further function after an element has arrived at the position that the dowel rod defines; that is, the dowel rod does not lock the elements of one ring to those of the rearwardly adjacent ring, any more than it locks circumferentially adjacent elements to one another. For ring-to-ring securement, each element has a pair of bores extending through it in the axial direction, and long bolts are inserted through these bores and threaded into sockets in the elements of the rearwardly adjacent, previously assembled ring.

Typically an arcuate tunnel liner element is three feet wide, as measured along the length of the tunnel, and therefore each of the bolts that secures it to rearwardly adjacent elements must be a little more than three feet long. Often a certain amount of manipulation of a bolt is necessary to get it properly engaged in the threaded socket that is to receive it, and then additional time has to be consumed in turning the bolt into the socket. Inserting and fastening each such bolt can take from about half a minute to a full minute, and sometimes longer. In tunnel work, time is very expensive, being typically estimated at more than $300 per working hour. With as many as six or eight arcuate elements in a typical ring—and substantially more in a large diameter tunnel—and with, typically, two bolts per element, the cumulative time required for inserting and screwing in the bolts represents a very substantial item of cost. Although substantially less time is consumed in inserting the dowel pins that position the elements, the number of such insertions that has to be performed in the assembly of a complete tunnel liner entails something more than a negligible cost.

During their history of about half a century, modular tunnel liners of the above described type have been improved in certain respects. See for example British Pat. No. 2,004,931. Heretofore, however, the skilled artisans working in this field have failed to devise an expedient that would eliminate or avoid the costs and inconveniences of dowel pins and long bolts.

SUMMARY OF THE INVENTION

The general object of the present invention is to provide a modular precast concrete element for assembly with other similar elements to form a tubular underground installation such as a duct or a liner for a tunnel or shaft, having simple means whereby the element can be brought into a desired position relative to at least one other similar and axially adjacent element and whereby the element, in being brought into that position, is permanently locked therein.

Thus it is another general object of the invention to effect a significant reduction in the cost of tunnels, shafts and underground ducts by providing a cast concrete modular element for a tubular underground construction, capable of being permanently assembled with other similar elements in substantially less time than has heretofore been required.

The objects of the invention can be achieved in modular concrete elements that are tubular in themselves, such as lengths of concrete pipe, as well as in arcuate segmental elements that are assembled with similar circumferentially adjacent elements to form rings; and thus it is also an object of the invention to simplify and facilitate the connection of precast concrete pipe and duct segments as well as simplifying and facilitating the underground assembly of segmented concrete tunnel and shaft liners.

Another and more specific object of the invention is to provide a cast concrete modular element for a tubular structure of the character described, which element has a pair of end surfaces facing in opposite axial directions and has a well opening to each of said surfaces wherein a rod is axially slidably receivable for guiding the element into a predetermined position axially adjacent to another, similar element, said modular element further having simple and inexpensive securement means in each of its said wells, each securement means being cooperable with a rod inserted into its well to confine the rod against withdrawal therefrom and thereby lock the element in the position to which it is guided by the rod.

It is also a specific object of the invention to provide a concrete modular element having the attributes just set forth and wherein the securement means comprises an annular securement member that is confined in a retaining means embedded in the concrete body of the element, said retaining means being, in itself, simple, inexpensive and easily assembled and preferably consisting of commercially available plastic water pipe components.

A further specific object of the invention is to provide a cast concrete modular element of the above described character that can be quickly and easily produced with simple and inexpensive molding apparatus.

In general, these and other objects of the invention that will appear as the description proceeds are achieved in a cast concrete modular element cooperable with other, similar elements to comprise a tubular underground installation such as a duct or a tunnel liner, said element having radially inner and outer surfaces curved concentrically to an axis that extends in opposite directions, having opposite end surfaces facing in said directions, and having a well opening to one of said end surfaces wherein a rod of a predetermined diameter is receivable for guiding said element to a predetermined position relative to another similar element, at which position said one end surface opposes an end surface on said other element. The modular element of this invention is characterized by retaining means defining a circumferential radially inwardly opening groove in said well that is spaced from said one end surface and provides opposing circumferential shoulders; and an annular securement member having a radially outer marginal portion confined in said groove, between said shoulders, and having radially inwardly projecting teeth which are resilient to be flexible away from said end surface and which, when unflexed, have radially inner edges on a circle of less than said diameter, to be flexed away from said end surface by a rod of said diameter inserted through the securement member and to hold the rod against withdrawal from the well by engaging it under convergent bias.

Preferably the retaining means comprises a plurality of tubular members that are fastened to one another in coaxial telescoping relationship and cooperate to define said circumferential shoulders. One of said tubular members has one end which defines one of said shoulders. Another of the tubular members is in surrounding relation to said one tubular member and the securement member to confine the latter against radial displacement. Said tubular members are embedded in the concrete of the modular element and provide axially oppositely facing external abutment surfaces that confine the retaining means against axial displacement in the element.

BRIEF DESCRIPTION OF DRAWINGS

In the accompanying drawings, which illustrate what are now regarded as preferred embodiments of the invention.

DETAILED DESCRIPTION OF PREFERRED EMBODIMENTS OF THE INVENTION

Figure 1:
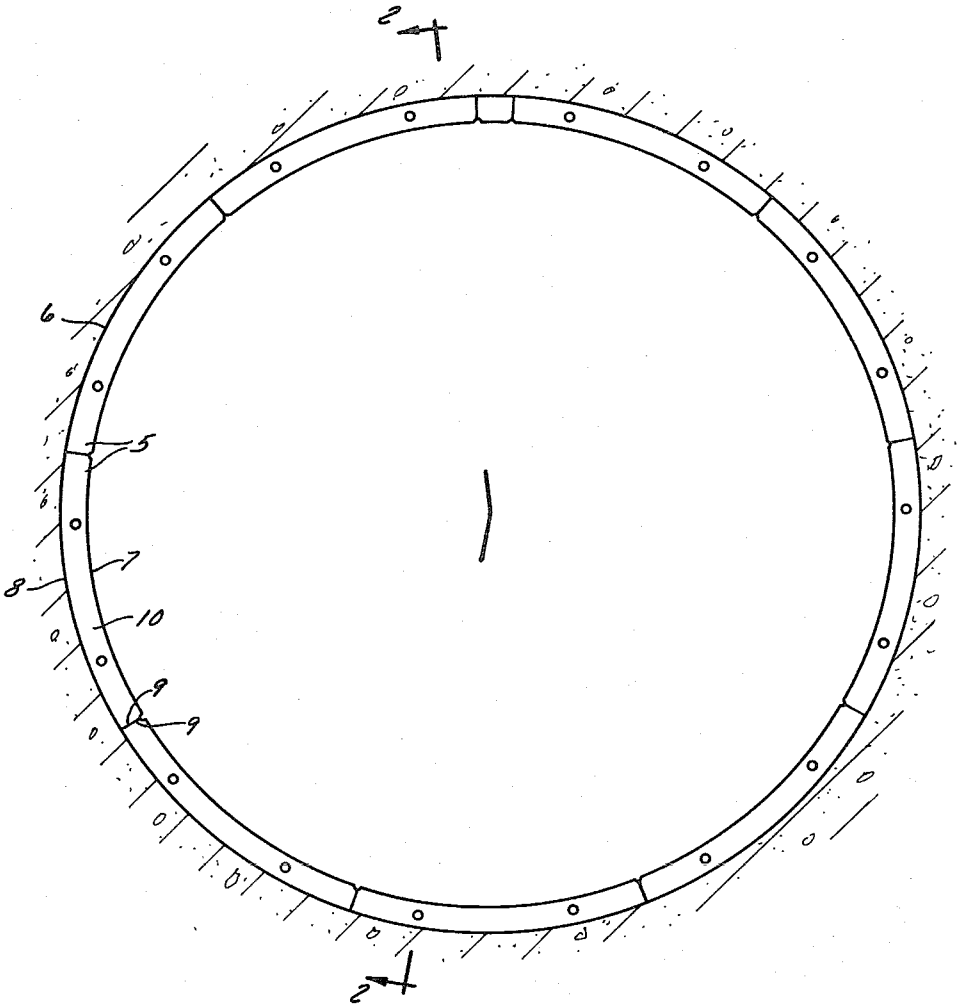
FIG. 1 is a view in elevation, looking in an axial direction, of an assembled ring of a tunnel liner comprising modular cast concrete segmental elements that embody the principles of this invention.
Figure 2:
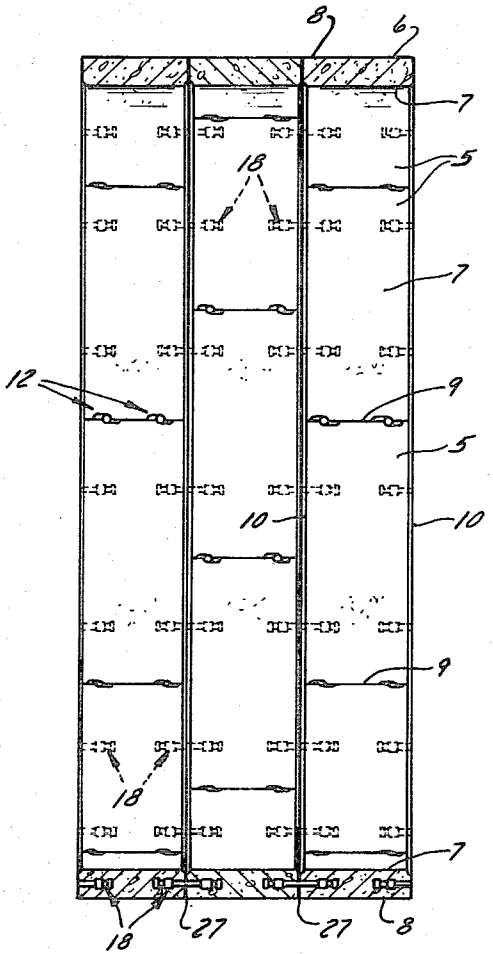
FIG. 2 is a view in longitudinal section, taken on the plane of the line 2—2 in FIG. 1.
Figure 3:
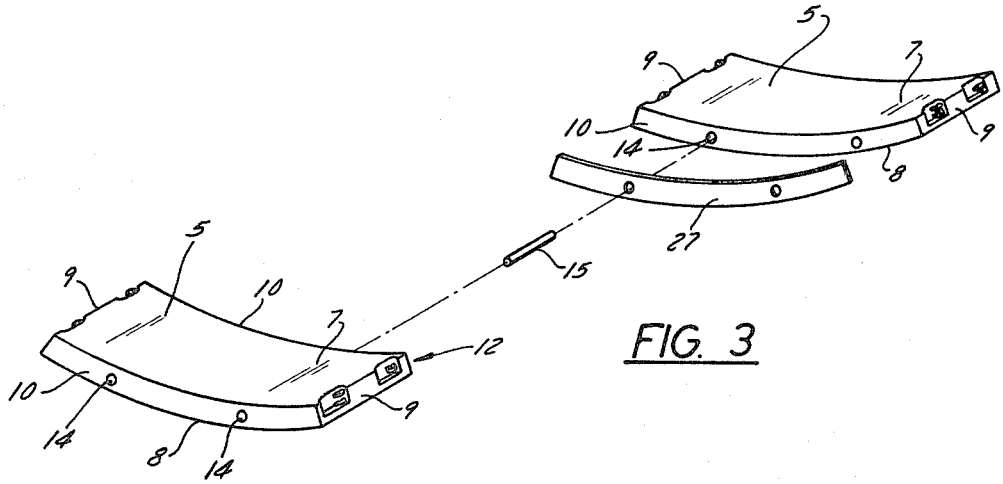
FIG. 3 is a perspective view of a pair of modular cast concrete segmental elements of the invention, shown in disassembled relation to one another and to a packing that is inserted between them.
Figure 4:
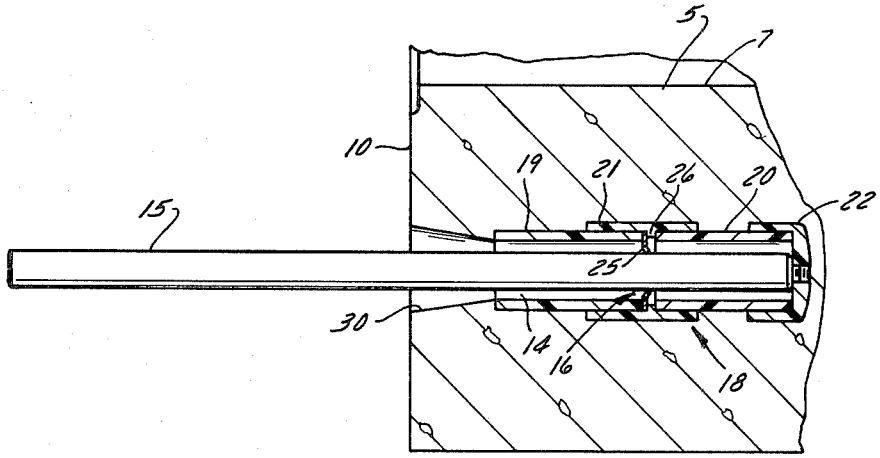
FIG. 4 is a view in longitudinal section through one of the modular elements, taken on the axis of one of the wells therein.
Figure 5:
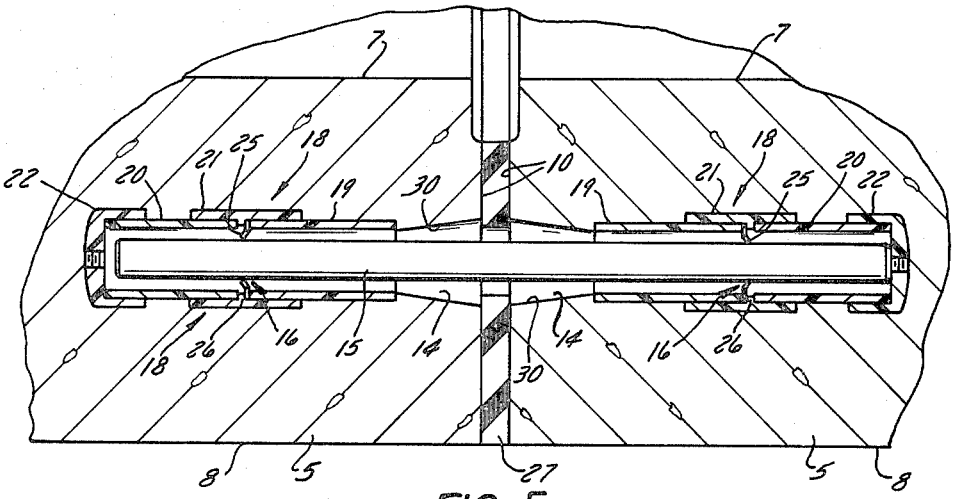
FIG. 5 is a view generally similar to FIG. 4 but showing a pair of axially adjacent modular elements connected with one another and with a packing in place between them.
Figure 7:
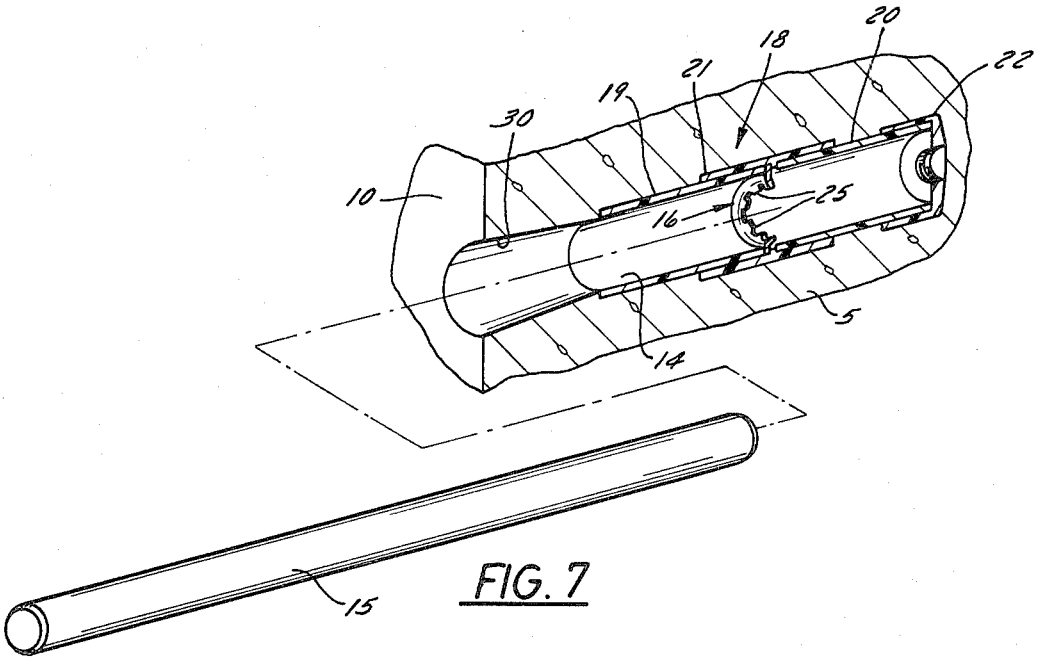
FIG. 7 is a fragmentary cut-away perspective view of a modular element in disassembled relationship to a rod that is received in one of its wells to secure it to a similar, axially adjacent element.

In one of its forms, particularly illustrated in FIGS. 1–5, 9 and 10, the present invention is embodied in a cast concrete modular element 5 that can be assembled inside a tunnel excavation with other, similar elements to comprise a liner for the tunnel. Each modular element 5 comprises a ring segment that can be assembled with a certain number of other such elements to comprise a ring 6, and the tunnel liner is built up by assembling such rings successively, in concentric, axially adjacent relationship to one another. Normally, assembly of the rings 6 will take place a short distance behind the zone at which excavation of the tunnel is occurring and will progress forwardly along the tunnel as it is being dug.

Each of the modular elements 5 has radially inner and outer faces 7 and 8, respectively, which are curved concentrically to an axis that will ultimately coincide with the axis of the tunnel liner that the element is to comprise. Each element 5 also has side faces 9 which will oppose similar side faces on circumferentially adjacent elements of a ring 6 and which therefore converge towards the axis just mentioned. Each element 5 also has end faces 10 that face in opposite axial directions. The end faces 10 will usually be parallel to one another, but on specialized elements they may be convergent to accommodate curvature of a tunnel.

Each modular element 5 of this invention has means 12 at its opposite sides for connecting it with circumferentially adjacent elements in a ring 6 that it comprises. The circumferential connecting means 12 bears a general resemblance to the heretofore conventional arrangement of loops or eyes that are secured by tapering wedge pins, but as more fully explained hereinafter, a modular element 5 of the present invention can be brought to its assembled position with an axial or mainly axial motion instead of requiring an almost purely circumferential motion.

The modular element 5 of this invention is characterized by wells 14 that open to its end faces 10 and have their axes substantially parallel to the axis about which its inner and outer faces 7 and 8 are curved. Preferably there are two wells 14 opening to each end face 10, each located one-quarter of the way around the arc of the element from one of its side faces 9. Each of the wells 14 can receive a rod 15 which is also received in a similar well in an axially adjacent element; hence the wells 14, in cooperation with the rods 15 that are received in them, establish the circumferential position of each element in relation to the circumferential positions of its axially adjacent elements.

In each of the wells 14 there is confined an annular securement member 16 that permits a rod 15 of a predetermined diameter to be inserted into the well with no difficulty but securely resists withdrawal of the rod from the well. Since each of the annular securement members 16 is rather thin, being shaped generally like a washer as more particularly described hereinafter, the securement member 16 is retained in the concrete body of the element 5 by an embedded retaining means 18 that comprises tubular members fastened in telescoped relationship to one another and defining an axially inner portion of the well 14.

Preferably the tubular members that comprise the retaining means 18 are conventional plastic water pipe pieces, secured to one another by means of the cement that is commonly used for making connections in such pipe systems. In this case the retaining means is made up of axially outer and inner lengths 19 and 20 of plastic pipe, connected end-to-end by a coupling 21 that embraces their adjacent end portions. A cap 22 over the inner end portion of the inner pipe length 20 defines the inner end of the well 14 and performs a supporting function during molding of the concrete element, as explained hereinafter.

The washer-like securement member 16 has an annular radially outer marginal portion 24 from which teeth 25 project radially inwardly. The teeth 25 are preferably inclined to the plane of the marginal portion 24 so that they project obliquely in one axial direction as well as radially inwardly, and they are resilient so that they can be flexed further in that axial direction.

The retaining means 18 is arranged to provide a circumferential radially inwardly opening groove in the well 14, which groove is spaced a substantial distance inward from the end face 10 to which the well opens. The marginal portion 24 of the securement member 16 is seated in that groove, axially confined between opposing circumferential shoulders that the groove defines and oriented to have the teeth 25 inclined toward the inner end of the well 14. The particular coupling 21 that is here illustrated is of a commercial type that has an internal circumferential ridge or land 26 midway between its ends, intended to be abutted by the adjacent ends of connected pipes when the coupling is used for a conventional plumbing connection. In the present adaptation of the coupling 21, its land 26 provides one of the circumferential shoulders that engage the securement member 16, and the other of those shoulders is defined by the adjacent end of one of the coupled pipe lengths 19, 20—the outer pipe length 19 as here shown. Thus, in the illustrated embodiment the groove in which the securement member 16 is confined is conjointly defined by the coupling 21 and the pipe length 19, and the coupling 21 closely surrounds the securement member to confine it against radial displacement. If a coupling were used that did not have the land 26, the adjacent ends of the connected pipe lengths would obviously provide the opposing shoulders for axial confinement of the securement member.

The rod 15 is of such diameter that it can fit in the bore of each of the pipe lengths 19, 20 with substantial clearance. However, the teeth 25 of the securement member when unflexed, have their inner edges on a circle of somewhat smaller diameter than the rod 15. Hence, when a rod 15 is inserted into the well 14 and through the securement member 16, the oblique axial inward inclination of the teeth 25 guides the rod into concentric relationship to the securement member and enables the rod to flex the teeth further in the axially inward direction, so that insertion of the rod is substantially unimpeded. But withdrawal of the rod 15 from the well is very securely resisted by the teeth 25, owing to their convergingly biased engagement with it whereby friction between the rod and the teeth translates axially outward force upon the rod into increased convergence of the teeth. The security with which the teeth 25 resist withdrawal of the rod can be increased by threading the portion of the rod that the teeth engage, or by providing that portion of the rod with small circumferential ridges; but a plain cylindrical rod has been found to be very satisfactory, especially if the teeth have reasonably sharp radially inner edges.

It will now be apparent that when modular elements 5 have been assembled into a complete ring 6, rods 15 can be inserted into the wells 14 that open to the front end faces 10 of those elements, to project forward from that ring and guide elements of the next forward ring into their proper positions relative to the elements of the assembled ring. The limit of axial insertion of each rod 15 into a well 14 in the assembled ring is of course defined by the engagement of the rod against the end cap 22 for its well. A new element 5, for assembly into a new ring, is of course guided into proper position by rods that project forwardly from two elements of the completed ring, which are received in the wells 14 that open to the rear end face 10 of the new element. So guided, the new element can be brought to its desired position by substantially axial rearward force upon it, which can be applied by means of a jack engaging its front end surface. Once in its desired position, the element is retained there by the one-way connection between the rods 15 and their respectively cooperating securement members 16.

Where expansion joint packings 27 are installed between axially adjacent modular elements 5, such packings can have apertures through them in which rods 15 are received. A packing 27 can be slipped over the rods that are to guide a new element into position, before the new element is engaged with those rods, and the packing will thus be positioned by positioning of the new element.

The assemblage of tubular members comprising each retaining means 18 is spaced inwardly from the adjacent end face 10 of the modular element in which it is embedded, and the end surfaces of the outer pipe length 19, the coupling 21 and the cap 22 provide abutments which cooperate with the surrounding concrete to confine the retaining means against displacement in the body of the member 5. Each of the wells 14 has an outwardly flaring concentric mouth portion 30, formed in the concrete body of the element and extending from the axially outer end of the retaining means 18 to the adjacent end face 10 of the element, for guiding a rod into the bores of the pipe lengths 19 and 20 that comprise the retaining means 18.

Typically a well 14 need not have a total depth of more than about six inches, and each rod 15 can have a length somewhat shorter than twice the depth of a well. The rods 15 are therefore light, inexpensive and easy to manipulate.

When a modular element 5 of this invention is to be cast, each of the retaining means 18 for the element is supported on an end wall 34 of the mold for the element by means of a mandrel 35 that has threaded opposite end portions 37 and 38. The mandrel 35 has a diameter substantially smaller than that of the rod 15 that is to be received in the retaining means 18, so that the mandrel can pass through the unflexed teeth 25 of the securement member 16 with substantial clearance. The end cap 22 of each retaining means has a concentric threaded hole in which one threaded end portion 37 of the mandrel 35 is engaged. A frustoconical spacer collar 39 that has a concentric sliding fit on the mandrel 35 is installed on it between the end wall 34 of the mold and the outer end of the outer pipe length 19, to establish the inward spacing of the retaining means 18 from the adjacent end face 10 of the element and to define the outwardly flared mouth portion 30 of the well 14. The mandrel 35 extends through a bore in the end wall 34 of the mold and is secured for the casting operation by means of a nut 40 threaded onto its projecting outer end portion. A screwdriver cross-slot 41 in the outer end of the mandrel facilitates tightening of the nut 40 and removal of the mandrel after the casting operation.

The means 12 for connecting an element 5 with its circumferentially adjacent elements in a ring 6 comprises U-shaped metal loop members 42 at each side of the element. Such loop fasteners 42 are, in themselves, generally conventional in modular cast concrete tunnel liner elements. Each loop member 42 has the extremities of its leg portions embedded in the concrete of its element 5 and has its semicircular bight portion 43 projecting beyond its adjacent side face 9 of the element to overlap a similar loop member on a circumferentially adjacent element. Each loop member 42 lies in a bay or pocket 45 in its element 5 that opens to the adjacent side face 9 and to the inner face 7 of its element. There are two such pockets 45 at each side of each element 5, spaced from one another and from the end faces 10. In one pocket 45 at each side of an element there are two of the loop members 42, spaced apart to receive between them a loop member 42 on a circumferentially adjacent element 5, while the other pocket 45' has a single loop member 42, for reception between a pair of loop members on a circumferentially adjacent element. Single-loop pockets 45' alternate with double-loop pockets 45 around the perimeter of the element 5. When a pair of circumferentially adjacent elements 5 are positioned in proper relationship to one another for connection, their loops overlap in two sets, with three loop members 42 in each set that so overlap as to cooperate in defining a circular eye into which can be driven a tapering pin 47 or similar fastener to hold the elements 5 connected. The pin 47 is driven from inside the ring 6, in the radially outward direction.

The pockets 45 tend to impose a constraint upon the direction in which an element 5 is brought into connecting relationship to a circumferentially adjacent one, inasmuch as each pocket must receive a projecting portion of a loop member on an adjacent element. To accommodate the motion of each element 5 in the axial direction that is needed for engaging rods 15 in its wells 14, each of the pockets 45, 45' is elongated in that direction and has its loop member or loop members near one end of the pocket so that the loop members of the circumferentially adjacent element can be received in the other end portions of the pockets. It will be observed that the pockets 45 and 45' at one side of the element are elongated in the direction away from one end face 10 of the element, while those at its other side are elongated in the direction away from the opposite end face. Desirably, the pockets 45, 45' are kept as small as possible because they are filled with grout after the tunnel liner is assembled.

Figure 12:
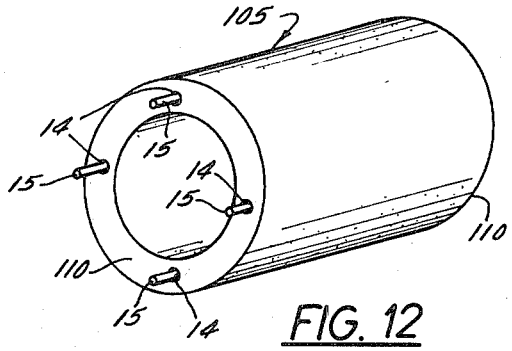
FIG. 12 is a perspective view of another form of modular element of this invention, intended for assembly into ducts such as sewers and water mains.
Figure 6:
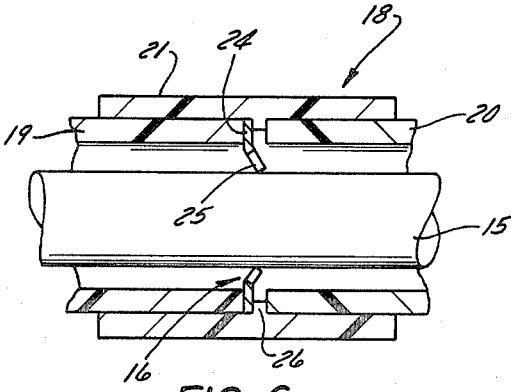
FIG. 6 is a detail sectional view, taken on the same plane as FIG. 4 but on a larger scale, showing the connection between the retaining means and the securement member.
Figure 8:
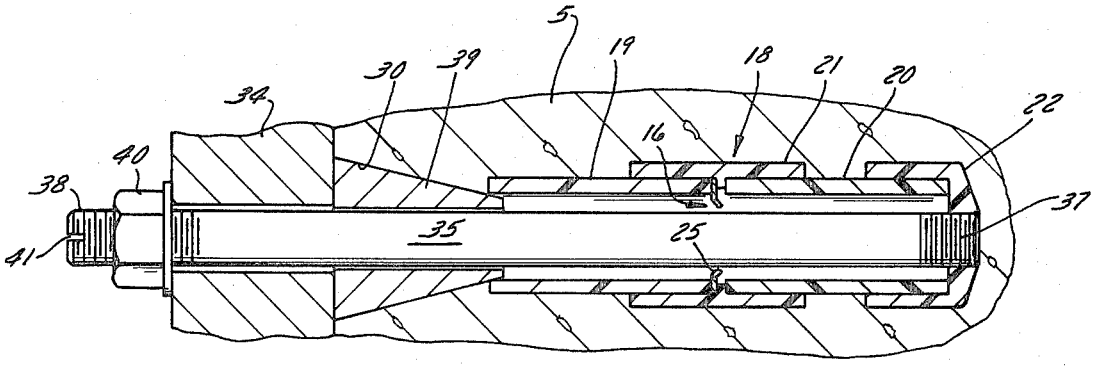
FIG. 8 is a view in longitudinal section through molding apparatus for casting a concrete element of this invention.
Figure 9:
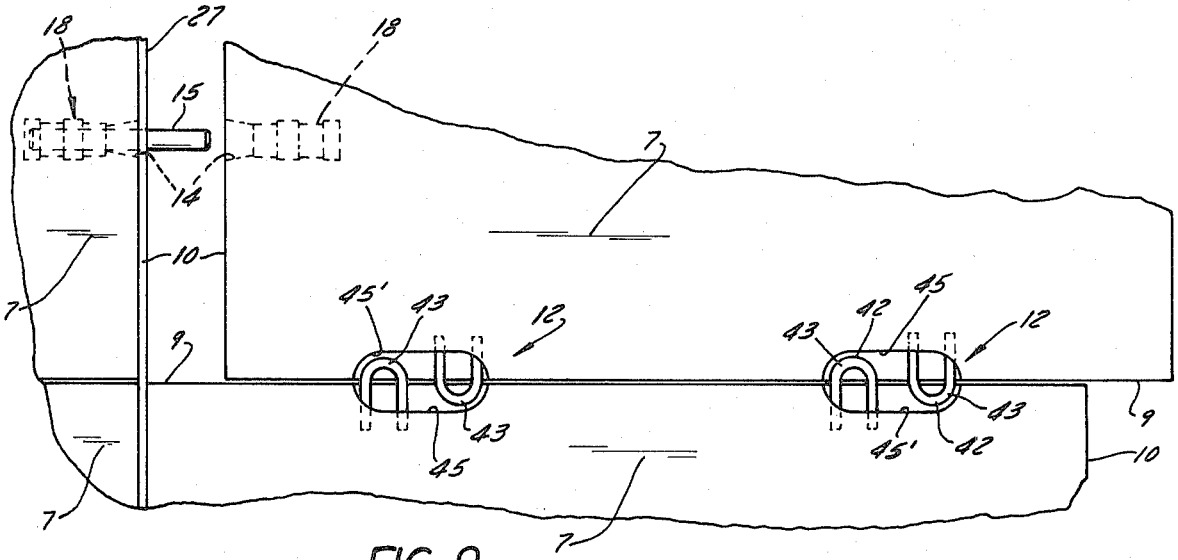
FIG. 9 is a fragmentary plan view showing a modular segmental tunnel liner element in position for assembly with similar elements that are to be circumferentially and axially adjacent to it.
Figure 11:
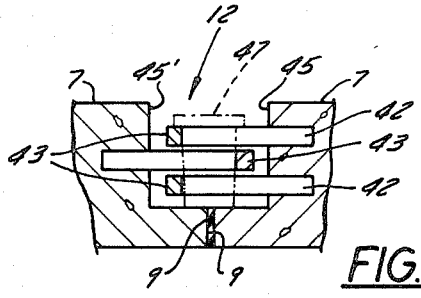
FIG. 11 is a detail view in section, taken on the plane of the line 11—11 in FIG. 10.
Figure 10:
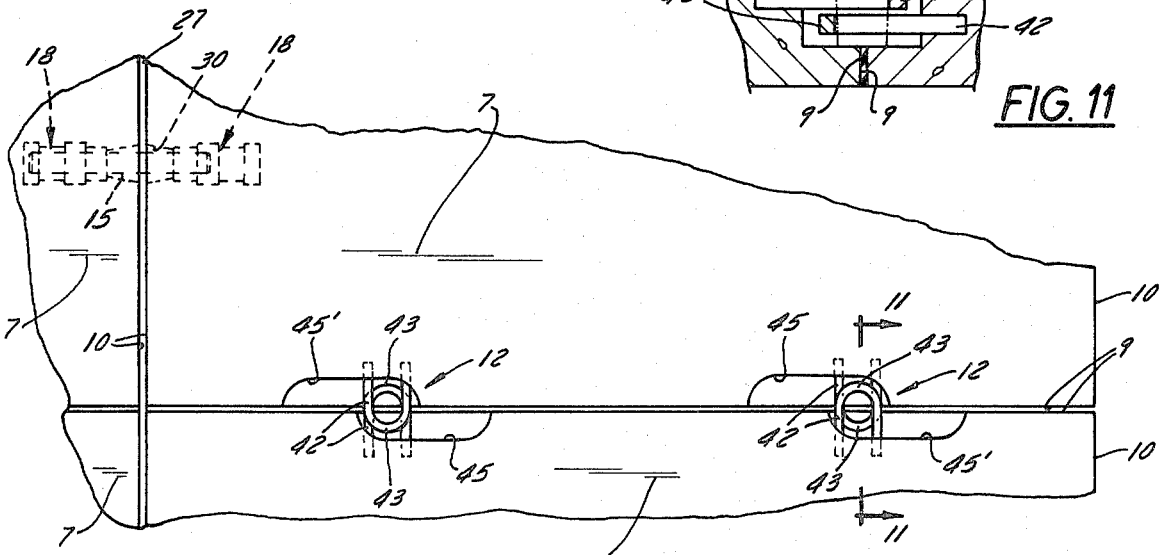
FIG. 10 is a view generally similar to FIG. 9 but showing the circumferentially and axially adjacent elements in fully assembled relationship to one another.

In the modified embodiment of the invention that is illustrated in FIG. 12, the modular element 105 is a length of cast concrete pipe, intended to be laid end-to-end with other, similar elements to comprise a tubular underground structure such as a sewer. In this case the element has wells 14 that open to each of its end faces 110, preferably spaced apart at regular circumferential intervals around it. Each such well is in part defined by a retaining means 18 that holds a securement member 16, as in the previously described embodiment of the invention; and, again, rods 15 are received in aligned wells 14 of axially adjacent elements 105 to guide the elements into desired positions relative to one another and to secure them in such positions.

From the foregoing description taken with the accompanying drawings it will be apparent that this invention provides a cast concrete modular element that is cooperable with other, similar elements to provide a tubular underground structure, having simple and inexpensive means for guiding axially adjacent elements into proper positions relative to one another and whereby the elements are securely and automatically locked against movement out of those positions.

What is claimed as the invention is:

1. A cast concrete modular element cooperable with other, similiar elements to comprise a tubular underground installation such as a duct or a tunnel liner, said element having radially inner and outer faces curved concentrically to an axis that extends in opposite directions, having opposite end faces facing in said directions, and having a well opening to one of said end faces wherein a rod of a predetermined diameter is receivable for guiding said element and another similar element into a predetermined axially adjacent relationship in which said one end face opposes an end face on said other element, said modular element being characterized by means for maintaining said relationship comprising:

A. a plurality of coaxial, telescopingly connected tubular members embedded in said element, cooperating to define a portion of said well that is spaced inwardly from said one end surface and providing opposing circumferential shoulders that define between them a circumferential radially inwardly opening groove in said portion of the well,
   (1) one of said tubular members having one end that defines one of said shoulders,
   (2) another of said tubular members being in surrounding relation to said one tubular member and defining a radially inwardly facing surface of said groove that extends axially between said shoulders, and
   (3) said tubular members having axially oppositely facing external abutment surfaces whereby they are confined against axial displacement relative to said element; and B. an annular securement member
   (1) having a radially outer marginal portion in said groove, confined between said shoulders and surrounded by said radially inwardly facing surface, and
   (2) having radially inwardly projecting teeth
      (a) which are resilient to be flexible away from said end surface and
      (b) which, when unflexed, have radially inner edges on a circle of less than said diameter, to be flexed away from said end surface by a rod of said diameter inserted into the well and to hold the rod against withdrawal from the well by engaging it under convergent bias.

2. The cast concrete element of claim 1 wherein said telescopingly connected tubular members are embedded in said element in inwardly spaced relation to said one end surface and wherein said element has an outwardly diverging bore portion extending coaxially from said telescopingly connected tubular members to said end surface for guiding a rod into said portion of the well.

3. The cast concrete element of claim 1, further having opposite side faces extending substantially in said directions, each opposingly engageable against a side face of another like element which is circumferentially adjacent to said element and with which said element cooperates to comprise a ring, further characterized by:
   (1) at least one substantially U-shaped loop member adjacent to each said side face of said element, said loop member
      (a) having legs that are spaced apart in said directions and are embedded in the element and
      (b) having a semicircular bight portion connecting said legs and projecting beyond its adjacent side portion to overlie the bight portion of a corresponding loop member on said circumferentially adjacent other element for securement thereto by a pin received in those bight portions; and
   (2) said element having a pocket for each loop member, opening to said radially inner face and to the side face adjacent to the loop member, wherein said loop member lies and said corresponding loop member is received, said pocket being substantially elongated in said directions to accommodate relative motion in said directions between the loop members in the pocket.

4. The cast concrete element of claim 1, further characterized by:
   (1) said one tubular member comprising a length of plastic pipe, and
   (2) said other tubular member comprising a plastic pipe coupling.

5. The cast concrete element of claim 3, further characterized by:
   (3) a second length of plastic pipe telescoped into said plastic pipe coupling in end-to-end relationship to said one tubular member.

6. The cast concrete element of claim 1 wherein the radially inwardly projecting teeth of said annular securement member, when unflexed, project obliquely radially inwardly and axially away from said end surface to cooperate in guiding an axially moving rod into concentric relation to the securement member.

7. The cast concrete modular element of claim 1 wherein said teeth, when unflexed, are inclined radially and axially inwardly to cooperate in guiding a rod through the securement member.

8. A cast concrete modular element having radially inner and outer surfaces curved concentrically to an axis that extends in opposite directions, having opposite side faces extending substantially in said directions, each opposingly engageable against a corresponding side face of another, similar, circumferentially adjacent element with which said element cooperates to comprise a ring, having opposite end faces facing substantially in said directions, and having a well opening to one of said end faces for receiving a rod of a predetermined diameter whereby said element and a further similar element are guided to a predetermined axially adjacent relationship in which said one end face opposes an end face on said further element, said modular element being characterized by:

A. retaining means in said element defining a circumferential radially inwardly opening groove in said well that is spaced from said one end surface and provides opposing circumferential shoulders;

B. an annular securement member
   (1) having a radially outer marginal portion confined in said groove, between said shoulders, and
   (2) having radially inwardly projecting teeth
      (a) which are resilient to be flexible away from said end surface and
      (b) which, when unflexed, have radially inner edges on a circle of less than said diameter, to be flexed away from said end surface by a rod of said diameter inserted through the securement member, and to hold the rod against withdrawal from the well by engaging it under convergent bias;

C. at least one substantially U-shaped loop member adjacent to each said side face
(1) having legs that are spaced apart in said directions and are embedded in said element, and
(2) having a semicircular bight portion connecting said legs and projecting beyond its adjacent side portion to overlie the bight portion of a corresponding loop member on said circumferentially adjacent other element for securement thereto by a pin received in those bight portions; and D. said element having a pocket for each loop member, open-into to its radially inner surface and to its side face adjacent to the loop member, wherein said loop member lies and said corresponding loop member is received, said pocket being substantially elongated in said directions to accommodate relative motion in said directions between loop members in the pocket.

9. The cast concrete element of claim 8, further characterized by said retaining means comprising:

a plurality of tubular members fastened to one another in coaxial telescoping relationship and cooperating to define said circumferential shoulders,
(1) one of said tubular members having one end that defines one of said shoulders,
(2) another of said tubular members being in surrounding relation to said one tubular member and the securement member to confine the latter against radial displacement, and
(3) said tubular members being embedded in said element and providing axially oppositely facing external abutment surfaces that confine the retaining means against axial displacement in the element.

10. The cast concrete element of claim 2 wherein said retaining means is embedded in said element in inwardly spaced relation to said one end surface and wherein said element has an outwardly diverging bore portion extending concentrically from said retaining means to said end surface for guiding a rod into said retaining means.

* * * * *